United States Patent [19]

Pierce

[11] 4,244,106

[45] Jan. 13, 1981

[54] DEVICE FOR DESCRIBING AN ELLIPSE

[76] Inventor: Donald C. Pierce, 1253 C. Redwood Blvd., Novato, Calif. 94947

[21] Appl. No.: 43,331

[22] Filed: May 29, 1979

[51] Int. Cl.[3] ..... B43L 11/04; B26B 3/00

[52] U.S. Cl. ..... 33/31; 30/164.9

[58] Field of Search ..... 82/1.3; 33/31; 30/164.9; 408/186; 83/464, 522

[56] References Cited

U.S. PATENT DOCUMENTS

| | | | |
|---|---|---|---|
| 1,474,868 | 11/1923 | Walker | 33/31 |
| 1,997,814 | 4/1935 | Dubois | 33/31 |
| 2,762,126 | 9/1956 | Shaw | 33/31 |
| 3,845,676 | 11/1974 | Pierce | 408/186 |
| 4,112,793 | 9/1978 | Pierce | 82/1.3 |

FOREIGN PATENT DOCUMENTS

| | | | |
|---|---|---|---|
| 585369 | 10/1933 | Fed. Rep. of Germany | 33/31 |
| 658082 | 1/1929 | France | 33/31 |

*Primary Examiner*—Harrison L. Hinson
*Attorney, Agent, or Firm*—Owen, Wickersham & Erickson

[57] ABSTRACT

A device for describing an ellipse. An enclosed arcuate first slot extends through a cylindrical shell. A path-generating disc fits inside the shell and enables the shell to rotate relatively thereto, and to it is secured a square bottom plate having a plurality of sharp points for centering the device. The disc has a diametrically-extending slot and, perpendicular thereto, a diametrically-extending recess in its upper surface. A cylindrical cam has a path-defining circular projection that rides snugly back and forth in the disc's recess. A cylindrical face of the cam has a radial opening aligned with and leading into another diametrical slot and a tangential opening parallel to that slot. An eccentricity-determining rod fits through the radial opening into the cam's slot, with sliding adjustment; its inner end extends out vertically into the disc's slot, for movement back and forth therealong. A radius rod, having one end secured in the cam's tangential opening, extends out through the shell's slot, and its outer end carries scribing means. A circular top closure for the shell has a slot parallel to the disc's recess and a scale along one edge of the slot for indicating the amount of eccentricity for which the device is set.

20 Claims, 17 Drawing Figures

DEVICE FOR DESCRIBING AN ELLIPSE

BACKGROUND OF THE INVENTION

This invention relates to a device enabling the hand cutting or marking of an ellipse and thereby enables one to hand-cut or mark ellipses.

The device is intended for use with photographic mounting board, paperboard, cardboard, paper, glass, and other materials, which are to be scribed or marked with an ellipse or from which an elliptical opening is to be cut out. The device is a simple, inexpensive hand-operated device which cooperates with a simple hand cutter or marker to cut a segment of the ellipse, preferably one quadrant at a time, thereby rotating one portion of the device relative to a fixed portion to enable cutting another quadrant, so that in four cuts a complete ellipse can be made.

In the past, oval cutters have been quite expensive, costing several hundred dollars and not always accurate even then. While these devices, and especially good ones such as those shown in my patents (U.S. Pat. Nos. 3,845,676, issued Nov. 5, 1974, and 4,112,793, issued Sept. 12, 1978), are quite useful to large enterprises where a lot of oval cutting is to be done, there is also a need for an inexpensive device for cutting ovals in such materials as cardboard or glass or for marking ovals with a pencil or other marking or scribing device, which can be used by smaller businesses or where oval cuts are less often required. This device can be made quite inexpensively and can still perform an excellent job.

For example, the devices of the present invention can be used in conjunction with my cutting device shown in co-pending U.S. patent application Ser. No. 22,423, filed Mar. 21, 1979.

Thus, one object of the invention is to provide a relatively inexpensive but still accurate oval-cutting device.

Another object of the invention is to provide an oval-cutting device that can be used with a hand-operated mounting board cutter or a glass cutter.

Another object of the invention is to provide an oval-describing device which can be used to mark, scribe, or cut ovals in various materials.

Another object of the invention is to provide a simple device for cutting one quadrant of an ellipse at a time.

Other objects and advantages of the invention will appear from the following description of a preferred embodiment.

SUMMARY OF THE INVENTION

Broadly speaking, the invention comprises a device for describing an ellipse. It includes a stationary portion having positioning means for locating and retaining a fixed position and a path-generating portion with an upper surface having first and second mutually perpendicular guides. A housing is rotatably attached to the stationary portion and has a sidewall, preferably cylindrical, with an enclosed first slot and an upper end wall. A rotatable follower assembly in the housing has first and second followers, one engaging each of the guides, and it has adjusting means for determining the position of the second follower relative to the first follower. One end is secured near the outer edge of the follower assembly. The rod extends out through the slot to a distal end having scribing means.

More specifically, as an example, the device may comprise a cylindrical shell which has an enclosed, arcuate, first slot extending through about 90° thereof and has an inturned bottom flange. A path-generating disc fits rotatably inside the shell with a shelf resting on the bottom flange, so that the bottom surface of the disc is preferably substantially flush with the bottom of the shell. An enclosed second slot extends diametrically through the disc, and a central recess with parallel edges extends diametrically across the upper face of the disc, perpendicular to the second slot. A square bottom plate is secured to the bottom surface of the disc; a plurality of sharp points project from a lower face of the bottom plate, for centering the position of the device relative to a base surface on which the ellipse is to be described. It will be described one segment at a time, preferably one quadrant at a time, and the bottom plate and disc remain stationary while the shell is rotated 90° between quadrants.

Above the disc and also inside the shell is a cylindrical cam having a lower face with a path-defining circular projection that rotates in and rides snugly back and forth in the disc's recess. An enclosed third slot extends diametrically across this cam. The cam has a cylindrical lower face with a radial opening therethrough aligned with and leading into the third slot, and there is a tangential opening parallel to the third slot. An eccentricity-determining rod fits slidably in this third slot and has an inner end extending vertically out from it and into the second slot, for movement back and forth therein. The cam is also provided with securing means for adjustably securing the eccentricity-determining rod in a desired position relative to the third slot, and thereby determining the eccentricity of the ellipse quadrant to be described. This securing means has a control portion on the upper face of the cam.

One end of a radius rod is secured in the tangential opening of the cam and extends out through said first slot. To the distal portion of this radius rod, is adjustably secured scribing means for cutting or marking the base surface.

The top of the shell is closed by a circular top closure member having an annular shelf that makes a snug closure against the top rim of the shell. This closure member has a radially-extending enclosed fourth slot, extending through it from adjacent the axial center of the shell out toward its edge. This closure member is aligned relative to the disc in such a way that the fourth slot is parallel to the disc's recess, and the upper surface of the closure member has a scale along one edge of the fourth slot for indicating, according to the position of the securing means, the amount of eccentricity for which the device is set.

Movement of the radius rod from one extremity to the other of the first slot and the resultant rotation of the cam, results in the rod moving the scribing means along a quadrant of an ellipse. Then the shell is rotated 90° relative to the fixed disc and bottom plate and another quadrant is cut or marked. Two more rotations of the shell and two more cuts or marks and the ellipse is completed.

DESCRIPTION OF SOME PREFERRED EMBODIMENTS

Figure 11:
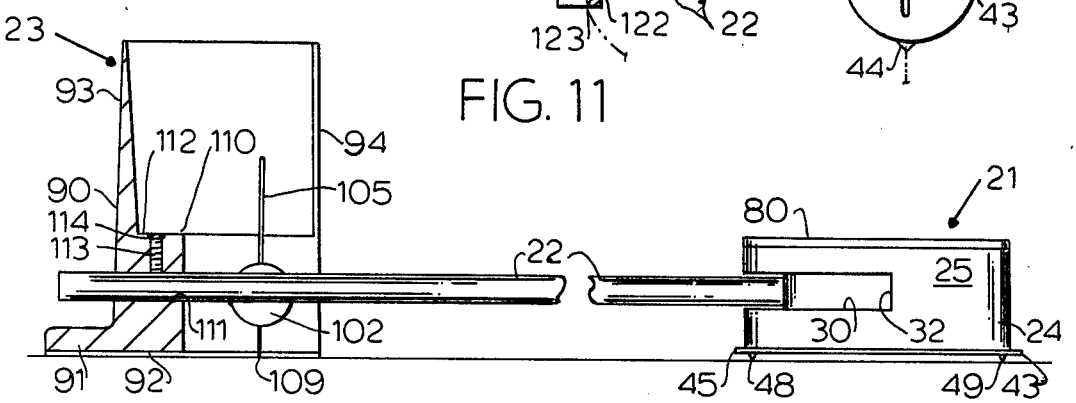
FIG. 11 is a view showing the device of FIGS. 1—3 and used in conjunction with a cutter assembly like that described in my co-pending U.S. patent application, Ser. No. 22,423, filed Mar. 21, 1979. The radius rod has been broken in the middle to conserve space.
Figure 12:
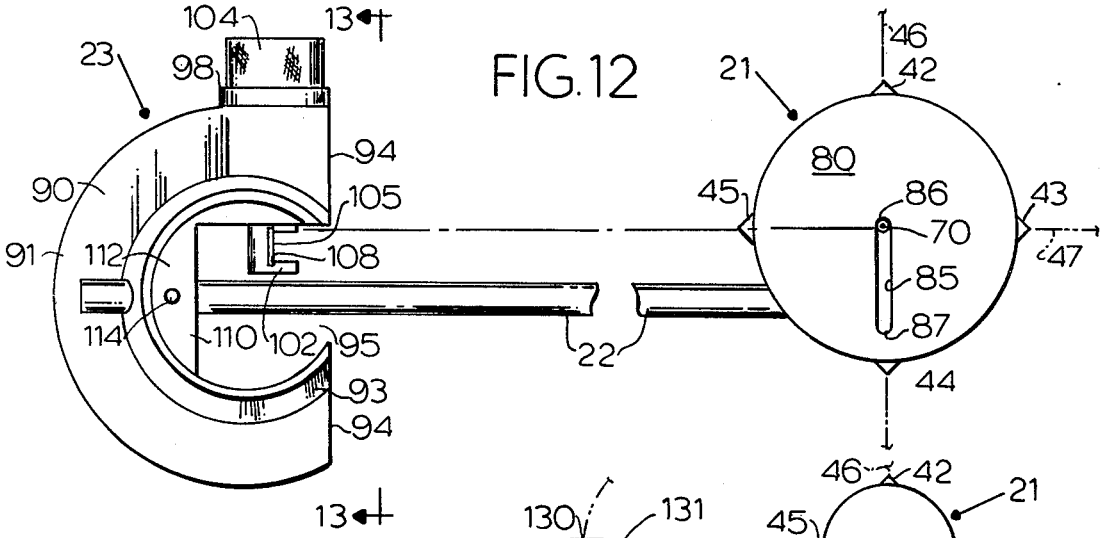
FIG. 12 is a top plan view of the assembly of FIG. 11. A broken line shows the alignment of the edge of the cutting blade and the center of the oval-scribing device.

FIGS. 11 and 12 show an assembly according to the present invention for cutting paper, cardboard, or mounting board, to provide a cut along a quadrant of a circle or an ellipse, the circle being considered a special case of ellipse. In this instance, there is a path-determining assembly 21, a radius rod 22, and a cutting assembly 23.

Figure 1:
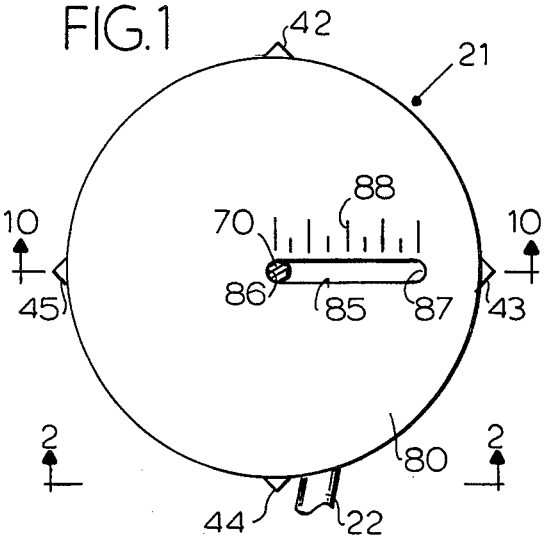
FIG. 1 is a top plan view of an oval-describing device embodying the principles of the invention. The radius rod has been broken off in order to conserve space.
Figure 2:
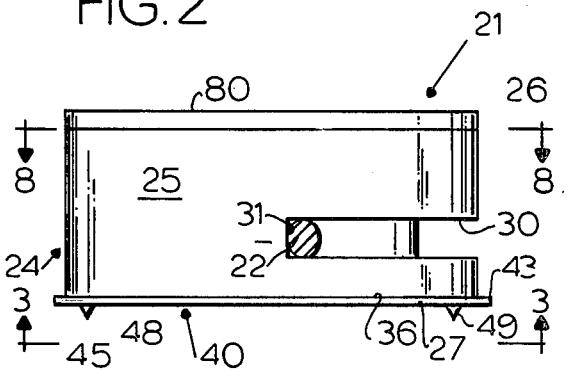
FIG. 2 is a view in section taken along the line 2—2 in FIG. 1.
Figure 3:
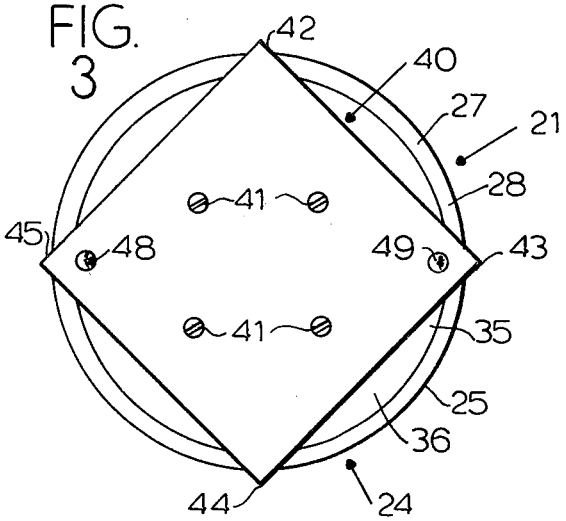
FIG. 3 is a bottom plan view of the device looking up from the line 3—3 in FIG. 2.
Figure 8:
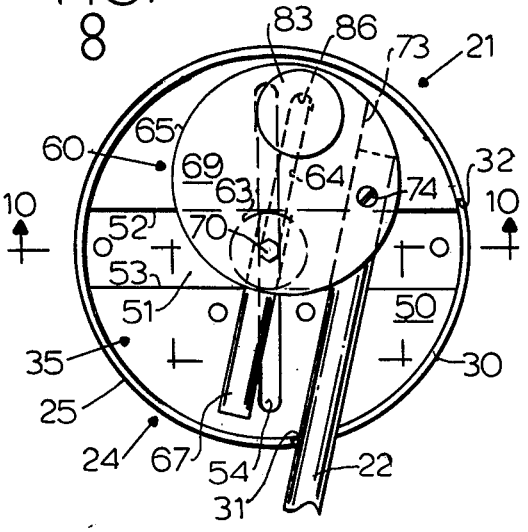
FIG. 8 is a view in section taken along the line 8—8 in FIG. 2, with the radius rod again broken off.
Figure 9:
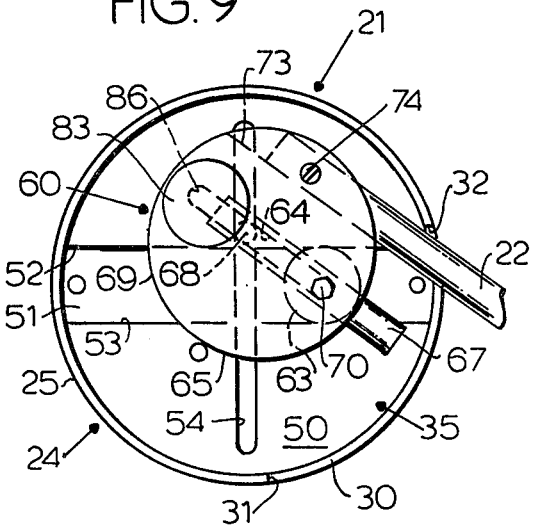
FIG. 9 is a similar view with the radius rod and cam in a different position.

FIGS. 1-3 illustrate the path-determining and center-locating assembly 21. A cylindrical shell 24 (see especially FIGS. 2 and 10) has a cylindrical wall 25, a top rim 26, and a bottom rim 27 with an inturned flange 28. It also has an enclosed arcuate slot 30 in its cylindrical wall, extending approximately 90° of arc between ends 31 and 32 (see FIGS. 8 and 9). As will be seen, the radius rod 22 extends out through this slot 30.

Figure 4:
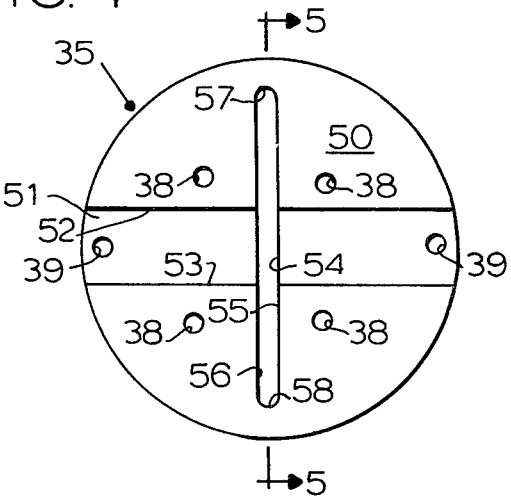
FIG. 4 is a bottom plan view of a path-defining disc forming part of the unit shown in FIG. 3.
Figure 5:
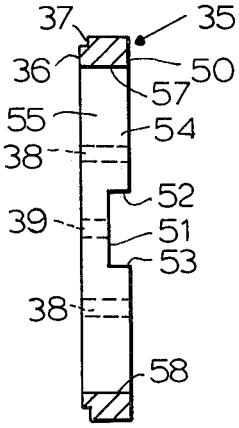
FIG. 5 is a view in section of the disc taken along the line 5—5 in FIG. 4.
Figure 6:
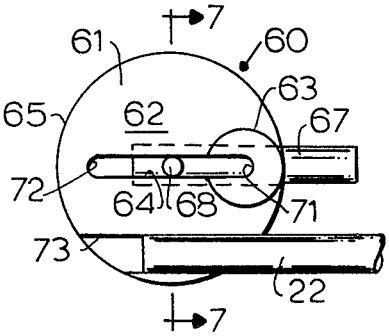
FIG. 6 is a bottom plan view of a cam assembly forming part of the unit of FIGS. 1-3 and lying just above the disc of FIG. 4.
Figure 7:
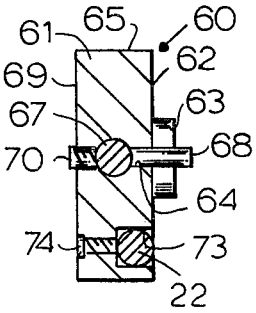
FIG. 7 is a view in section taken along the line 7—7 in FIG. 6.
Figure 10:
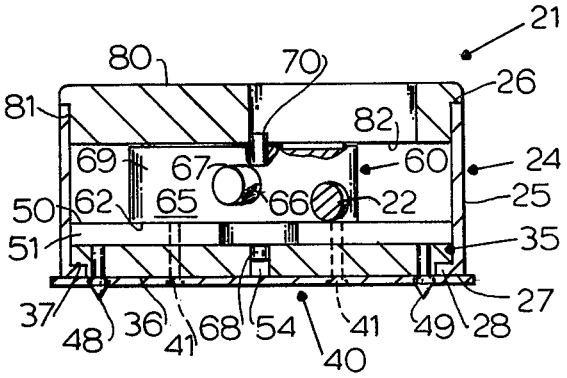
FIG. 10 is a view in section of the device taken along the line 10—10 in FIG. 8, but also showing the top closure member in place.
Figure 14:
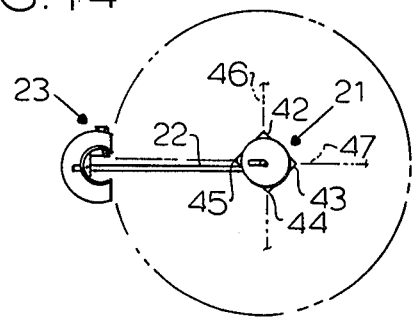
FIG. 14 is a plan view illustrating how the device may be used to cut a quadrant of a circle.
Figure 15:
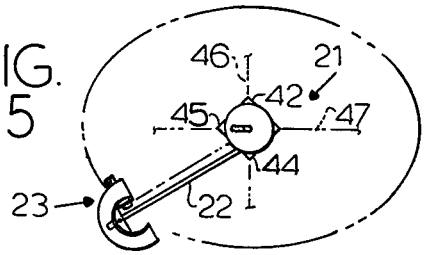
FIG. 15 is a similar view illustrating how the device may be used to cut a quadrant of an oval.

A path-generating disc 35 (see FIGS. 4, 5, and 10) is located inside the shell 24 in a manner providing for relative rotation between the disc 35 and the shell 24. The disc 35 has a bottom surface 36 around which is a recessed annular shelf 37, which as shown in FIG. 10, rests on the flange 28 of the shell 24 so that the disc's bottom surface 36 is flush with the bottom rim 27 of the shell 24. There are threaded openings 38 and 39 in or through the disc 35. A square bottom plate 40 is secured, as by four screws 41 threaded into the openings 38 of the disc 35, to the bottom 36 of the disc 35, and preferably abuts the surface 36 snugly. The square plate 40 is preferably made to be large enough so that its corners 42, 43, 44, and 45 project out beyond the circumferential sidewall 25 of the shell 24. These corners can be used to locate the center of the device accurately, with the aid of two mutually perpendicular intersecting lines 46 and 47, which may, for example, be drawn on a sheet of mounting board or other material to be cut (see FIGS. 14 and 15), and the corners 42, 43, 44, 45 of the square are aligned with these lines. A pair of sharp points 48 and 49 are provided (as by threaded members secured in the openings 39 of the disc) to project out from the bottom plate 40, to enable the device 21 to be held in place securely by one's hand. There may be more than two points 48 and 49, and they may be located elsewhere than is shown in the drawings. Thus, the corners 42, 43, 44, and 45 of the square plate 40 locate the device 21 on the paper or mounting board to be cut, and by having a plurality of points 48, 49, the device 21 can readily by held by hand in a stationary position since it is not intended that the plate 40 and disc 35 rotate during the cutting.

However, the shell 24 is intended to be rotated between successive quadrants. This is possible because the disc 35 is mounted for rotation relative to the shell 24. In order to prevent accidental rotation, advantage may be taken of the points 48 and 49, locating them close to the flange 28, so that when they are inserted up through the plate 40 and threaded into the disc 35, they act to cause the edge of the plate 40 and the shelf 37 of the disc 35 to clamp the flange 28 between them, not enough to prevent purposeful rotation but enough to prevent accidental rotation. Thus, during operation, while the points 48 and 49 hold the plate 40 and disc 35 in place as a stationary device-locating and path-generating means, the shell 24 can readily be rotated relatively thereto.

The disc 35 has an upper surface 50 (FIG. 5) provided with a diametrically-extending recess 51 that extends all the way across the disc 35 and is defined by a pair of parallel walls 52 and 53. Perpendicular to the recess 51 and crossing it at the exact center of the disc 35 is a slot 54, which extends all the way through the disc 35. This slot 54 also has parallel sidewalls 55 and 56 and, being an enclosed slot, has ends 57 and 58.

Above the disc 35 and inside the shell 24 is a cam assembly 60 shown best in FIGS. 6 through 10. This may comprise a cylindrically-shaped member 61 having on its lower surface 62 a circular projection 63 which is adapted to ride back and forth in the recess 51 of the disc 35. A slot 64 extends diametrically across most of the width of the member 61, but does not go all the way across. The slot 64 has parallel sidewalls and end walls. It extends approximately halfway into the circular projection 63 to a point just beyond the projections's center. This cam member 61 has a cylindrical wall 65 through which is a radial opening 66 (See FIG. 10) that extends directly into and is in line with the slot 64. Within this opening 66 and the slot 64 is located much of an eccentric-determining rod 67. An inturned end 68 of the rod 67 extends out from the cam 60 substantially perpendicular to the face 62 and engages the slot 54 of the disc 35, moving back and forth therein as the cam 60 is rotated. An upper face 69 of the cam member 61 has a screw 70, preferably an Allen-head type, which enables one to adjust the position of the eccentric-determining rod 67 and therefore the position of its end portion 68 relative to the center of the circular projection 63. Being on the upper face 69, this screw 70 can be adjusted from above without having to take the device 21 apart. This setscrew 70, therefore, as will be seen, enables the operator to set the eccentricity of the ellipse. There can be zero eccentricity (for a circle) when the end 68 lies at the center 71 of the projection 63, or there can be up to the amount of eccentricity obtained when the end 68 lies at the end 72 of the slot 64 most distant from the projection 63.

The cam assembly 60 also has a substantially tangential opening or slot 73 which receives the radius rod 22. On the upper face 69 is a setscrew 74, so that the position of the radius rod 22 relative to the cam member 61 can be adjusted, although usually once the radius rod 22 has been clamped in place it is left there.

The assembly 21 is completed by a top closure member 80, which has an annular recess 81 around its circumference (See FIG. 10) so that it fits snugly into the space defined by the rim 26 of the shell 24 and closes the upper end of the shell 24. In order that the device 21 may be snug and tight, a lower surface 82 of the member 80 may come into engagement with the upper surface 69 of the cam member 61. Where this is done, it is preferable to provide a disc 83 of Teflon, or other low-friction material, secured in the cam member 61 and extending very slightly above it to reduce friction between the rotating cam 60 and the stationary closure member 80.

The top closure member 80 is provided with a radially-extending slot 85 going from approximately the center 86 of the member 80 to a point near its outer edge 87. Preferably, a calibrated scale 88 is located along one side thereof. Through the slot 85 an Allen-type wrench may be used to engage the Allen-head setscrew 70 and move it, so that the cam rod 67 is moved along the slot 64 relatively to the cam 60 and to the closure member 80, and then the screw 70 may be tightened. The effect of this is to determine the amount of eccentricity of the ellipse to be cut, and the amplitude of this eccentricity may be read along the scale 88.

Figure 13:
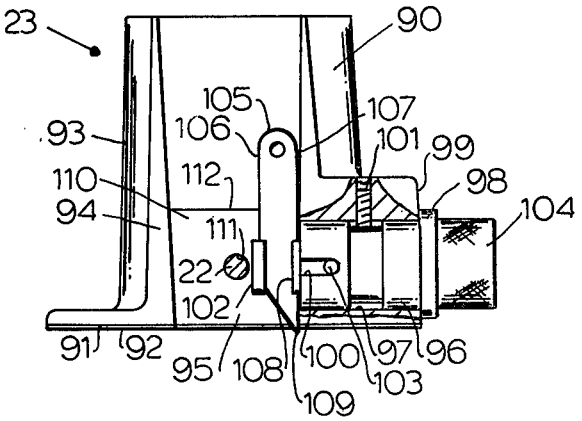
FIG. 13 is an end view taken along the line 13—13 in FIG. 12, with a portion broken away and shown in section.

Various types of devices can be used in conjunction with the assembly 21 and radius rod 22. FIGS. 11–13 show the use therewith of a cutting device 23 of the type shown in my co-pending U.S. patent application, Ser. No. 22,423, filed Mar. 21, 1979. This device 23 comprises a handle and support member 90 with a flat base portion 91 having a generally flat bottom wall 92. An upwardly-extending generally annular portion 93 terminates at each end at a generally vertical planar surface 94 which is divided into two segments by a gap 95. This surface 94 is designed for using the cutting device 23 in conjunction with a straight edge. The bottom surface 92, at least, is preferably low-friction material, to make it easy to move the device 23 along a surface.

A sleeve 96 extends through a horizontal through opening 97 and has a flange 98 that bears against a bearing wall 99, and a slot 100 parallel to its axis leads in from one end of the sleeve 96. A setscrew 101 may be used for holding this sleeve 96 in any desired rotational position. A shaft 102 fits inside the sleeve 96 and is locked to it against relative rotation by a pin 103 engaging in the slot 100. An outer end of the shaft 102 is preferably threaded to receive a nut 104 which clamps the flange 98 of the sleeve 96 against the bearing wall 99. The inner end of the shaft 102 has a recess or channel 108 to receive a cutting blade 105. As shown, the blade 105 may be an elongated flat strip of metal with two parallel edges 106 and 107 that fit in the channel 108 in the shaft 102, and the depth of the cut is determined by sliding the blade 105 in the channel 108 to a desired depth; thus the cutting depth of the blade 105 is readily adjustable. The point 109 of the blade 105 generally rests adjacent the support member itself, and there is a trailing edge. The nut 103 may be used to set the blade 105 at any desired angle, by rotation of the shaft-sleeve combination, the setscrew 101 being loosened temporarily for that purpose.

The cutter 23 also has a block portion 110 through which an opening 111 extends to receive the radius rod 22, and the block portion 110 has a shelf surface 112 from which a setscrew opening 113 extends into the opening 111. A setscrew 114 inserted therein can hold the cutter 23 at any desired position along the radius rod 22. Therefore, it is not necessary to move the radius 22 relative to the cam member 61, but only to move the cutter 23 itself along the radius rod 22 to a desired position and then lock it there.

When the assembly shown in FIGS. 11 and 12 is set up at a desired distance for the minor axis of the ellipse, then the eccentricity is adjusted by the screw 70 to provide the ellipse with its major axis. The device 21 is then located on a sheet of paper or cardboard or mounting board by lightly drawing the two intersecting lines 46 and 47 and aligning the four corners 42, 43, 44, and 45 of the square plate 40 with those lines 46 and 47 and pressing down on the device 21 enough to force the two points 48 and 49 to engage the board. Then with the radius rod 22 starting at one end of the slot 30, the cutter 23 is moved by hand in the direction toward the trailing edge of the blade 105 to rotate the radius rod 22. This rotation necessarily rotates the cam member 61, and the rod 67 follows the slot 54 while the projection 63 moves in and along the recess 51. Hence, the cutter 23 cuts one quadrant of an ellipse. This may not end up being exactly 90° on a long ellipse, though it will be 90° on a circle. The shell 24 is then rotated 90° while holding the plate 40 and disc 35 in place; this shifts the slot 90° around 90°. During this shift the radius rod 22 and cam 60 remain in place. Then the next quadrant is cut. By making two more such shifts of the shell 24 and cuts by the blade, a complete ellipse is cut.

Figure 16:
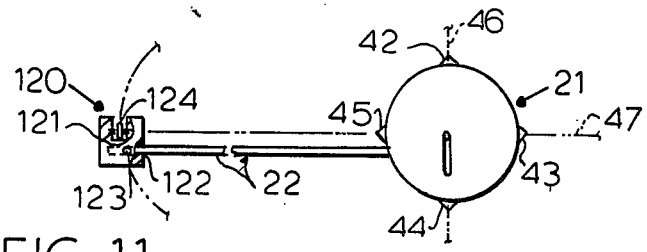
FIG. 16 is a view similar to FIG. 11 showing the device of FIGS. 1-10 combined with a glass cutter.

The device 21 may also be used in conjunction with a glass cutter 120, as shown in FIG. 16. In this instance, again, one quadrant is scribed or cut at a time. The glass cutter 120 comprises a body 121 having an opening 122 therethrough for reception of the radius rod 22 and a setscrew 123 for holding any position to which it is set. The body 121 also supports rotatably a glass-cutting disc 124 of hard steel or other suitable material. The operation is exactly the same as before, except that the glass cutter 120 does not, of course, cut all the way through the glass but merely scribes a line which is then, when satisfactorily deep, used to break out the glass to provide an elliptical opening.

Figure 17:
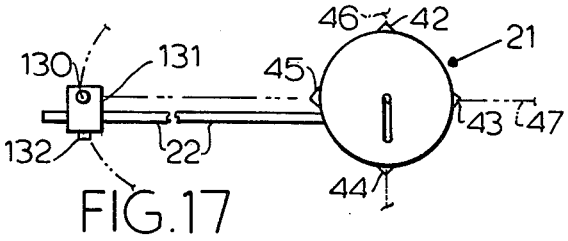
FIG. 17 is a similar view showing the device mounting a pencil.

As shown in FIG. 17 the device may also be used with a pencil 130 simply to mark a circular or elliptical area, if that is desired. Here is shown a pencil holder 131 which is slidable along the radius rod 22 and is held in any desired position by setscrew 132, which may in this instance be a thumbscrew. In the claims, the term "scribing means" is intended to include pencils and other marking devices as well as glass cutters and knife blades.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A device for describing an ellipse on a surface, including in combination:

a stationary portion having positioning and aligning means for locating and retaining a fixed position on said surface, a path-generating portion having two mutually perpendicular guides, and for aligning said guides relative to said surface, a rotatable follower assembly having first and second followers, one engaging each said guide, and adjusting means for determining the position of the second follower relative to said first follower, and a radius rod having one end secured near the outer edge of said follower assembly and extending out therefrom to a distal end having scribing means.

2. The device of claim 1 having means for retaining said guides and said followers in engagement at all times.

3. A device for describing an ellipse on a surface, including in combination:

a stationary portion having positioning means for locating and retaining a fixed position on said surface and a path-generating portion having two mutually perpendicular guides, a housing rotatably attached to said stationary portion and having a sidewall with an enclosed slot, a rotatable follower assembly in said housing having first and second followers, one engaging each said guide, and adjusting means for determining the position of the second follower relative to said first follower, and a radius rod having one end secured near the outer edge of said follower assembly and extending out through said slot to a distal end having scribing means.

4. The device of claim 3 having clamping means for loosely clamping the housing relative to the stationary portion for allowing purposeful rotation but preventing accidental rotation.

5. The device of claim 3 wherein said scribing means comprises a cutting blade.

6. The device of claim 3 wherein said scribing means comprises a glass-cutting roller.

7. The device of claim 3 wherein said scribing means comprises a writing instrument.

8. A device for describing an ellipse on a surface, including in combination:

a stationary portion having positioning means for locating and retaining a fixed position on said surface and a path-generating portion with an upper surface having first and second mutually perpendicular recesses, a housing rotatably attached to said stationary portion and having a cylindrical wall with an enclosed slot and an upper end wall, a rotatable cylindrical cam with a path-defining circular projection that rotates in and rides snugly back and forth in said first recess, guide means for engaging in said second recess, and adjusting means for determining the position of said guide means relative to the center of said circular projection, and a radius rod having one end secured near the outer periphery of said cam and extending out through said slot to a distal end having scribing means.

9. The device of claim 8 wherein said stationary portion has a square bottom portion with corners and a plurality of sharp points projecting downwardly for determining the center of and ellipse.

10. The device of claim 8 wherein said path- generating portion fits rotatably in said housing.

11. The device of claim 8 wherein said guide means and said adjusting means comprise:

an enclosed second slot in said cam extending diametrically across the lower face of said cam and across half of said circular projection, a cylindrical wall having a radial opening therethrough aligned with and leading into said second slot, an eccentricity-determining rod fitting slidably in said second slot and having an inner end extending vertically out from said second slot into said enclosed slot, for movement back and forth therein, and securing means for securing said eccentricity-determining rod in any desired position relative to said third slot, thereby determining the eccentricity of the ellipse to be described.

12. The device of claim 8 wherein said upper end wall is provided with a slot therethrough and said adjusting means includes index and control means in line with said slot and directly determining the position of said guide means.

13. A device for describing an ellipse, including in combination:

a stationary portion having a square bottom portion with corners and a plurality of sharp points projecting downwardly for determining the center of an ellipse and a path-generating portion with an upper surface having a diametrically-extending recess and, perpendicular to said recess, a diametrically-extending first slot, a rotatable housing rotatably attached to said stationary portion and having a cylindrical wall with an enclosed second slot and an upper end wall, a rotatable cylindrical cam with an upper face, a lower face having a path-defining circular projection that rotates in and rides snugly back and forth in said recess, an enclosed third slot extending diametrically across the lower face of said cam and half of said projection, a cylindrical wall having a radial opening therethrough aligned with and leading into said third slot, and a tangential opening parallel to said third slot, an eccentricity-determining rod fitting slidably in said third slot and having an inner end extending vertically out from said third slot into said first slot, for movement back and forth therein, securing means for securing said eccentricity-determining rod in any desired position relative to said third slot, thereby determining the eccentricity of the ellipse to be described, and a radius rod having one end secured in said tangential opening of said cam and extending out through said second slot to a distal end having scribing means.

14. The device of claim 13 wherein said securing means has an adjusting head and said upper end wall has a slot therethrough aligned with said adjusting head at all times, so that the position of the eccentricity-determining rod can be adjusted by inserting a tool through said slot and into driving relation with said head.

15. The device of claim 14 wherein the upper end wall engages an upper surface of said cam, said cam's upper surface having a slightly raised portion only of low-friction material in actual engagement with said wall.

16. A device for describing an ellipse, including in combination:

a cylindrical shell having an enclosed first arcuate slot and an inwardly-extending bottom flange, stationary device-locating and path-generating means having a cylindrical disc fitting in said shell and bearing against said flange, for rotation of said shell relative to said disc, and having a bottom surface at the bottom of the shell and an upper surface having a diametrically-extending enclosed second slot and, perpendicular to said second slot, a diametrically-extending recess, said stationary means also having a square bottom plate outside said shell, secured rigidly to the bottom of said cylindrical portion and having a lower face, a plurality of sharp pointed members extending down from said lower face for determining the position of said device-locating and path-generating means relative to a base surface on which the ellipse is to be described, a rotatable cylindrical cam with an upper face, a lower face having a path-defining circular projection that rotates and rides back and forth in said recess, an enclosed third slot extending diametrically across said cam and to the center of said projection, and a cylindrical face having a radial opening therethrough aligned with and leading into said third slot and a tangential opening parallel to said third slot, an eccentricity-determining rod fitting slidable in said third slot and having an inner end extending vertically out from said third slot into said second slot, for movement back and forth therein, securing means for securing said eccentricity-determining rod in any desired position relative to said third slot and thereby determining the eccentricity of the ellipse to be described, and a radius rod having one end secured in said tangential opening of said cam and extending out through said first slot to a distal end having scribing means.

17. The device of claim 16 wherein said sharp pointed members are located near said flange and have portions extending up through said plate and threaded into said disc, exerting clamping pressure by said disc and said plate on opposite sides of said flange so as to prevent accidental rotation of said shell while allowing purposeful rotation thereof.

18. The device of claim 17 wherein said disc has a recessed shelf engaging said flange, the bottom of said disc otherwise being flush with the bottom of said shell.

19. The device of claim 16 having an end closure member closing the upper end of said shell and having a slot and a calibrated scale along said slot, said securing means having an adjusting head aligned with said slot and moving with said eccentricity-determining rod.

20. A device for describing an ellipse, including in combination:

a cylindrical shell having an enclosed first slot extending through about 90° thereof, a path-generating disc fitting snugly but rotatably inside said shell having a bottom surface at the bottom of the shell and an upper surface, a diametrically-extending enclosed second slot therethrough, and, perpendicular to said second slot, a diametrically-extending recess in said upper surface, a square bottom plate secured to the bottom surface of said disc and having a lower face from which project a plurality of sharp points for determining the position of said disc relative to a base surface on which the ellipse quadrant is to be described, a cylindrical cam with an upper face, a lower face having a path-defining circular projection that rotates in and rides snugly back and forth in said disc's recess, an enclosed third slot extending diametrically across said cam and across half of said projection, and a cylindrical face having a radial opening therethrough aligned with and leading into said third slot and a tangential opening parallel to said third slot, an eccentricity-determining rod fitting slidably in said third slot and having an inner end extending vertically out from said third slot into said second slot, for movement back and forth therein, a radius rod having one end secured in said tangential opening of said cam and extending out through said first slot to a distal end, securing means for adjustably securing said eccentricity-determining rod in a desired position relative to said third slot and thereby determining the eccentricity of the ellipse to be described, said securing means having a control portion on the upper face of said cam, a circular top closure member having an annular shelf making a snug closure against the top rim of said shell and an opening affording access to said control portion, and scribing means for cutting or marking said base surface, adjustably secured to the distal portion of said radius rod, the radius rod being moved from a first end of said first slot to the other to describe a quadrant of an ellipse, the shell then being rotated while the bottom plate and radius rod remain stationary until the first end of the first slot again engages the radius rod, describing another quadrant of the ellipse, and so on until the complete ellipse is described.

* * * * *